US007727614B2

(12) United States Patent
Stubing

(10) Patent No.: US 7,727,614 B2
(45) Date of Patent: Jun. 1, 2010

(54) EDGE PROTECTOR WITH CUSHION INSERT

(75) Inventor: Dan Stubing, Neenah, WI (US)

(73) Assignee: Great Northern Corporation, Appleton, WI (US)

( * ) Notice: Subject to any disclaimer, the term of this patent is extended or adjusted under 35 U.S.C. 154(b) by 341 days.

(21) Appl. No.: 11/829,236

(22) Filed: Jul. 27, 2007

(65) Prior Publication Data

US 2009/0029130 A1 Jan. 29, 2009

(51) Int. Cl.
*B32B 3/30* (2006.01)

(52) U.S. Cl. ..... 428/119; 428/122; 206/586; 229/199; 229/918; 217/69; 248/345.1

(58) Field of Classification Search ..... 428/119, 428/122; 206/586; 229/199, 918; 217/69; 248/345.1

See application file for complete search history.

(56) References Cited

U.S. PATENT DOCUMENTS 6,655,101 B2 * 12/2003 Harel ..... 52/287.1
6,915,603 B2 * 7/2005 Hunt ..... 40/312

* cited by examiner

*Primary Examiner*—Alexander Thomas
(74) *Attorney, Agent, or Firm*—Andrus, Sceales, Starke & Sawall, LLP

(57) ABSTRACT

An edge protector is provided for protecting an edge or corner of an article. The edge protector includes a cushion insert having an inner surface adapted to engage the corner of the article, and an outer surface provided with a pair of spaced apart retaining elements. A reinforcing body has an inner surface engaged against the outer surface of the cushion insert and a pair of spaced apart outer edges retained by the retaining elements of the cushion insert.

9 Claims, 4 Drawing Sheets

EDGE PROTECTOR WITH CUSHION INSERT

BACKGROUND OF THE INVENTION

The present invention generally relates to elongated edge protectors for protecting an edge or corner of an item being shipped or transported. More specifically, the present invention relates to an elongated edge protector having a cushion insert to provide additional protection, durability and reinforcement at the corner of the item being shipped.

Packages, articles, products, palletized loads and the like are often subject to damage during shipping or transit. One traditional method of shipping a product, such as a large appliance, involves packaging the product within a cardboard box having cardboard inserts for positioning and holding the product within the box. After each product is packaged within a box, individual boxes or multiple boxes are assembled into an orderly stack onto a pallet or shipping crate. Once the product or products are positioned onto the pallet, the entire pallet is typically wrapped in a heat shrinkable plastic sheet to maintain the integrity of the assembled stack.

During shipment and storage, the corner edges of each box may become damaged. Thus, before the product or products are wrapped with the heat shrink plastic material, edge protectors are often used along the outside corners of the individual box or assembled stack. Edge or corner protectors are typically formed from one or more pieces of paperboard, cardboard and/or corrugated cardboard folded into a rigid V-shape member having a pair of transversely oriented leg members joined at an apex.

In certain situations and with certain products, it is desirable to provide a cushioned edge protector that enables ease of use while providing adequate strength and product protection. Although a cushioned edge protector is desirable, the edge protectors must also be stackable for storage prior to use.

Typically, cushioned edge protectors are most often formed from expanded polystyrene foam (EPS) which has good cushioning properties for protecting the product being shipped but has a tendency to break apart and lose its integrity upon contact with other articles. When this type of cushioned edge protector is used during shipment of products, the edge protector can become broken and damaged, which creates an unpleasant appearance and reduces the effectiveness of the protector.

SUMMARY OF THE INVENTION

The present invention relates to an edge protector for protecting an edge or corner of an article. The edge protector includes a cushion insert that adds to the durability and reinforcement of the edge protector along the corner of the article being protected. The cushion insert has an inner surface adapted to engage the corner of the article, and an outer surface provided with a pair of spaced retaining elements. The edge protector also includes a reinforcing body having an inner surface engaged against the outer surface of the cushion insert and a pair of spaced apart outer edges retained by the retaining elements of the cushion insert.

In one embodiment, the retaining elements of the cushion insert are defined by a pair of retaining channels. The outer edges of the reinforcing body are inserted beneath the retaining elements such that the retaining elements limit the separation of the cushion insert from the reinforcing body. In one embodiment, the cushion insert has a length that is substantially equal to a length of the reinforcing body. However, it is also contemplated that multiple, smaller cushion inserts could be spaced along the length of the reinforcing member.

Preferably, the cushion insert has a thickness that is greater than a thickness of the reinforcing body. The reinforcing body lies coextensively along the outer surface of the cushion insert between the spaced retaining elements.

In a preferred embodiment, an edge protector is provided for protecting an edge or corner of an article. The edge protector includes the cushion insert having an inner surface adapted to engage the corner of the article, and an outer surface provided with a spaced apart, notched channels. The edge protector also includes a reinforcing body formed of a plurality of layers of paperboard plies laminated together, the body having an inner surface engaged against the outer surface of the cushion insert and a pair of outer edges retained in the channels of the cushion insert.

The cushion insert and the reinforcing body include a generally right angle cross-section defined by respective first legs and respective second legs of the cushion insert and the reinforcing body. The inner surface of the cushion insert defines a corner receiving structure. The outer edges of the reinforcing body are inserted in the channels such that the reinforcing member is held in place relative to the cushion insert.

BRIEF DESCRIPTION OF THE DRAWINGS

The drawings illustrate the best mode presently contemplated of carrying out the invention and drawings.

DETAILED DESCRIPTION OF THE INVENTION

Figure 1:
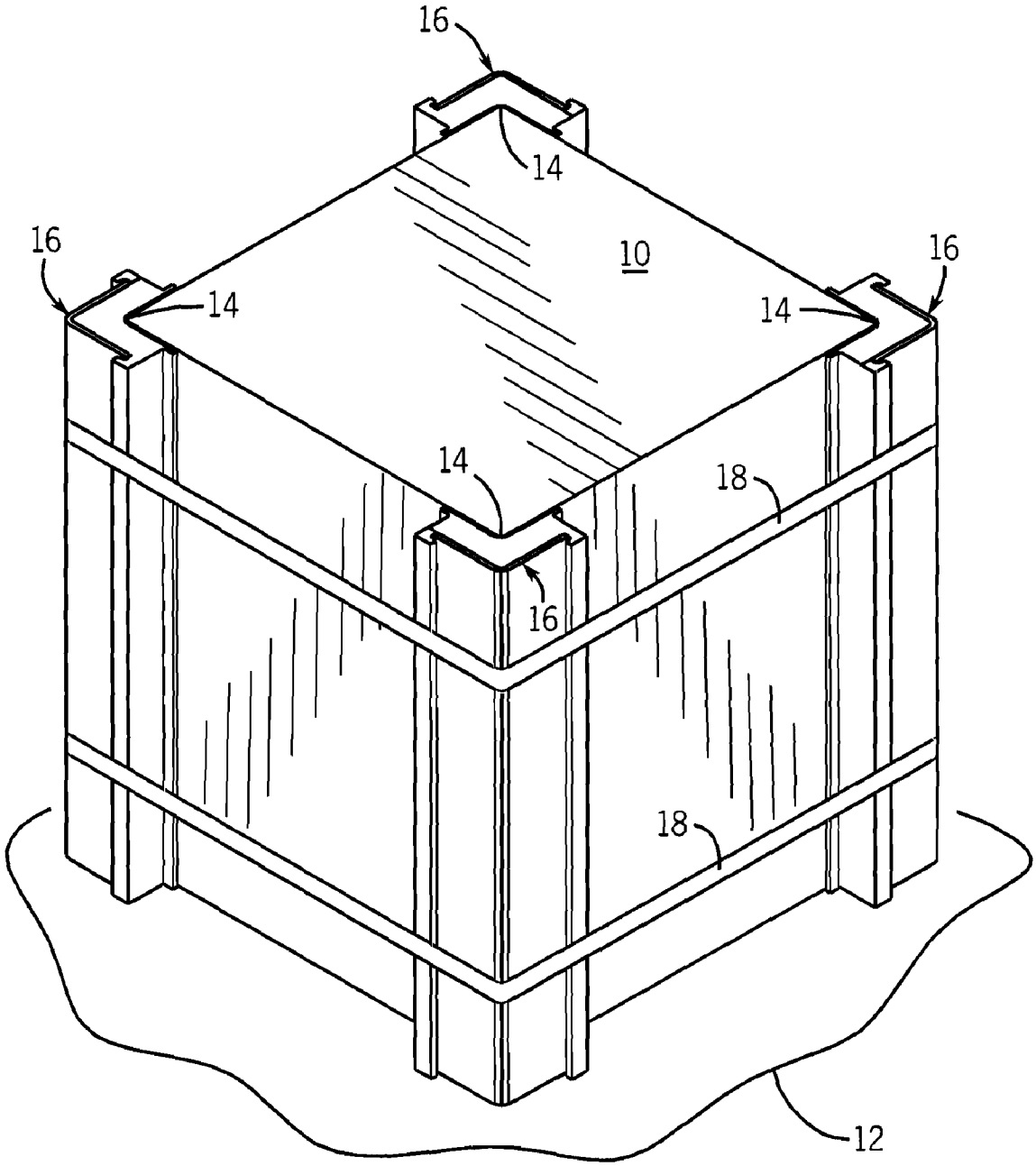
FIG. 1 is a perspective view of an article to be shipped which utilizes the edge protector of the present invention.

Referring first to FIG. 1, an individual article 10 is shown supported on a surface 12 in preparation for storing or shipment. In the embodiment shown in FIG. 1, the article 10 is the product being shipped, such as a large appliance or piece of furniture. The article 10 shown in FIG. 1 defines outer corners 14 that are exposed and can be damaged during storage and shipment. To protect the corners of the article, a packaging system including multiple edge protectors 16 and retaining straps 18 can be used. The edge protectors 16 are positioned along the outer corners 14 of the article 10 and protect the corners of the article 10 from damage during shipment and from the pressure exerted by the retaining straps 18. The retaining straps 18 could be replaced by a shrink wrap plastic material.

While an individual article 10 is shown with the packaging system in FIG. 1, it should be understood that a plurality of articles 10 could be stacked together, such as on a pallet, with the outer corners of the stack being protected by a similar packaging system.

Figure 2:
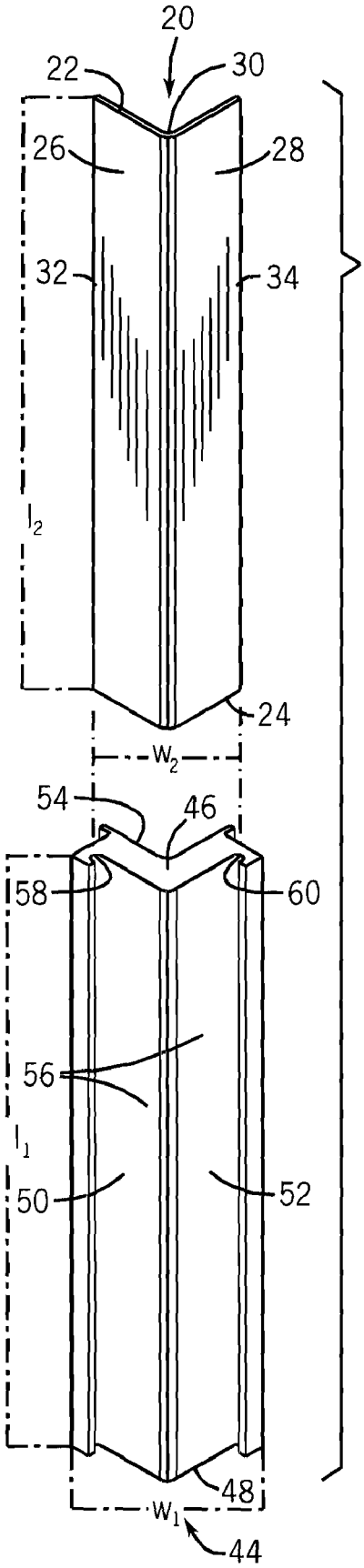
FIG. 2 is a vertically exploded view of the edge protector.
Figure 3:
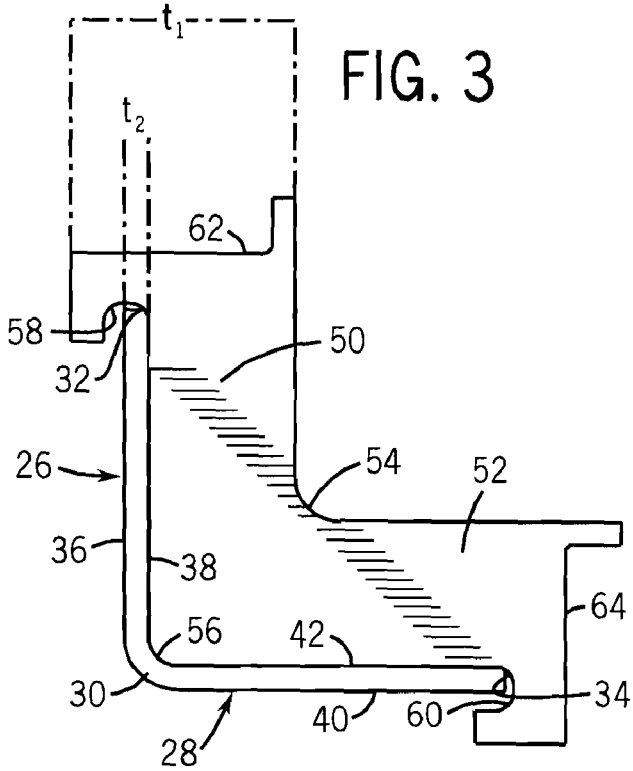
FIG. 3 is a top view of an assembled edge protector.

Referring to FIGS. 2 and 3, the edge protector 16 includes an elongated reinforcing body 20 extending between a first end 22 and a second end 24. The main body 20 has a generally 90° right angle cross-section formed by a first leg 26 and the second leg 28 joined to each other along an apex 30. The first leg 26 extends from the apex 30 to an outer edge 32 while the second leg 28 extends from the apex 30 to outer edge 34.

The main body 24, including the first and second legs 26, 28, is preferably formed from a plurality of paperboard plies laminated together and formed into the generally V-shaped right angle configuration shown in FIGS. 2 and 3. The manufacturing of a right angle edge protector is well known in the industry. It should be appreciated that while the preferred material of the main body is a paperboard construction that other materials such as plastic could be suitably used.

As to be understood in FIG. 3, the angle between the first leg 26 and the second leg 28 is preferably close to 90°. However, due to the manufacturing process used to form the reinforcing body 20, the angle defined by the apex may be slightly greater than or slightly less than the desired 90°.

As can be seen in FIG. 3, the first leg 26 includes an outer face surface 36 and an inner face surface 38. Likewise, the second leg 28 also includes an outer face surface 40 and an inner face surface 42. The outer face surfaces 36, 40 of the edge protector 16 can be formed from either a strip of paperboard material or can include a clay-coated paper label. The use of a paper label along the outer face surfaces 36, 40 allows graphics to be printed along the outer face surfaces 36, 40 as is well known.

With further references to FIGS. 2 and 3, the edge protector 16 also includes an elongated cushion insert 44 extending between a first end 46 and a second end 48. The cushion insert 44 has a generally 90° right angle cross-section formed by a first leg 50 and a second leg 52. The cushion insert 44 has an inner surface 54 formed at a generally 90° angle which is adapted to directly engage a corner 14 of the article 10. The cushion insert 44 further has an outer surface 56 which includes a pair of spaced apart retaining elements preferably formed as notched channels 58, 60. The channels 58, 60 are designed to receive and retain the respective outer edges 32, 34 of the reinforcing body 20. Although the cushion insert 44 is shown as including channels 58, 60 that extend along the entire length of the cushion insert from the first end 46 to the second end 48, it is contemplated that the channels 58, 60 could be interrupted along the length of the cushion insert 44. In such an embodiment, the interrupted channel sections would be spaced sufficiently to provide the required holding force for the reinforcing body 20. The inner and outer surfaces 54, 56 of the cushion insert 44 are joined by sidewalls 62, 64.

The cushion insert 44 is preferably formed from expanded polystyrene foam (EPS), but could be constructed from other cushioning materials. In FIG. 3, the first leg 50 and the second leg 52 are substantially identical and the cushion insert 16 is symmetrical in shape.

In the embodiment shown in FIG. 2, the cushion insert 44 has a length $l_1$ that is substantially equal to the length $l_2$ of the reinforcing body 20. The cushion insert 44 has a thickness $t_1$ which is greater than the thickness $t_2$ of the reinforcing body 20. The cushion insert 44 also has a width $w_1$ which is greater than a width $w_2$ of the reinforcing body 20.

Figure 4:
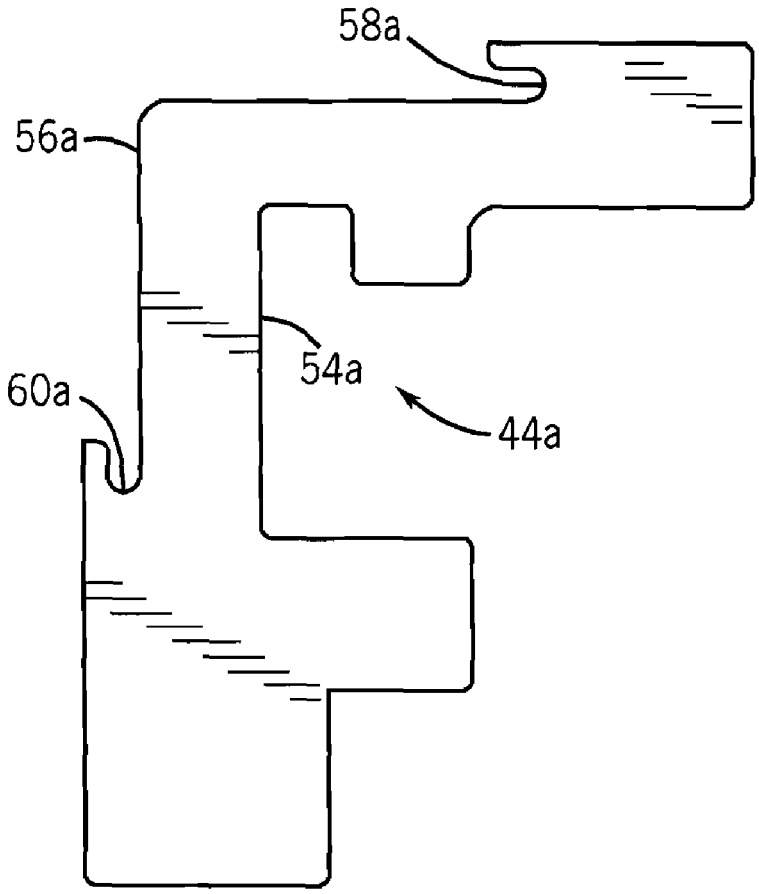
FIGS. 4 and 5 are top views of differently shaped cushion inserts used in the edge protector.
Figure 5:
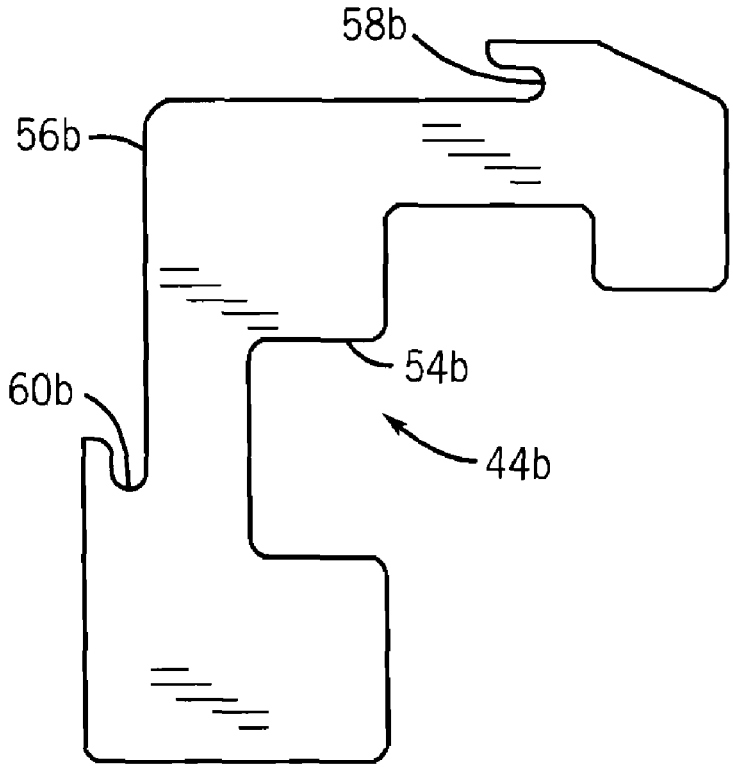

It should be understood that the cushion insert 44 is not strictly confined to the cross-sectional shape shown in FIG. 3. FIGS. 4 and 5 show alternative embodiments of cushion in inserts 44*a* and 44*b*, respectively, which differ in cross-sectional shape, but commonly include inner surfaces 54*a* and 54*b* that are adapted to engage different corner structures of article 10. Cushion inserts 44*a* and 44*b* also commonly include outer surfaces 56*a* and 56*b* similar to outer surface 56, which are formed with retaining channels 58*a*, 60*a* and 58*b*, 60*b*, respectively, for receiving respective outer edges 32 and 34 of reinforcing body 20.

In use, the reinforcing body 20 can be joined to the cushion insert 44 by inserting the outer edges 32, 34 of the reinforcing body 20 into the channels 58, 60 of the cushion insert. This can be accomplished by either sliding the reinforcing body 20 along the cushion insert 44 from the first end 46 to the second end 48 or by inserting one of the outer edges 32, 34 into the corresponding channel 58, 60 and flexing the reinforcing body 20 about the apex 30 until the opposite outer edge 32, 34 can be received within the corresponding channel 58, 60. The reinforcing body 20 is held against lateral dislodgement by the walls of the channels 58, 60. With the inner surfaces 38, 42 of the reinforcing body 20 lying coextensively along the outer surface 56 of cushion insert 44, the edge protector 16 is placed against each corner 14 of the article 10. Protective packaging can be completed by placing retaining straps 18 or shrink wrap material around the edge protectors 16. The use of the edge protector 16 at the corners of article 10 adds enhanced durability and reinforcement, while providing additional protection for the article 10. Furthermore, the reinforcing body 20 and the cushion insert 44 are shaped to permit stacking of these components prior to their use.

Although the cushion insert 44 is shown in FIG. 2 as having a length that is substantially equal to the length of the reinforcing body 20, it is contemplated that the length of the cushion insert 44 could be substantially less than the length of the reinforcing body 20. In such an embodiment, multiple cushion inserts 44 could be spaced along the length of the reinforcing body 20. In such an embodiment, each of the cushion insert sections would have a similar profile to the cushion insert 44 shown in FIG. 3 and would be spaced along the entire length of the reinforcing body 20. Likewise, it is also contemplated that the thickness of the cushion insert can vary greatly depending upon the amount of cushioning required for the articles being shipped and the space requirements available for the packaging system.

Figure 6:
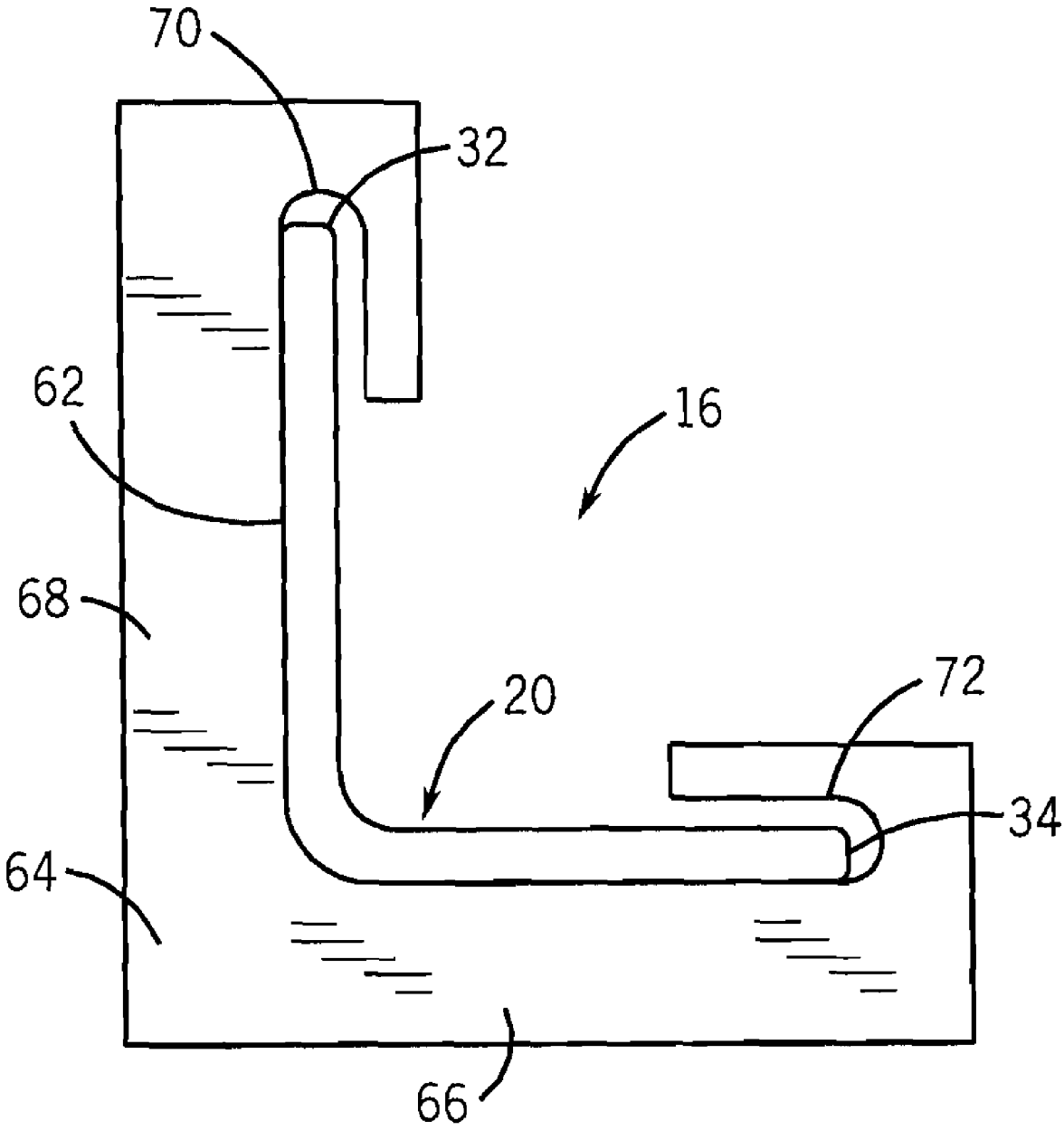
FIG. 6 is a top view of an alternate embodiment of the edge protector.

Referring now to FIG. 6, there shown is yet another alternate embodiment of the edge protector 16. In the embodiment shown in FIG. 6, the elongated reinforcing body 20 is received along an inner surface 62 of the cushion insert 64. The inner surface 62 is formed as part of both the first leg 66 and the second leg 68 and defines part of the channels 70, 72. Each of these channels 70, 72 receives one of the outer edges 32, 34 of the reinforcing body 20 to hold the reinforcing body 20 in the condition shown in FIG. 6. In the embodiment shown in FIG. 6, the cushion insert 64 can either have the same length as the elongated reinforcing body 20 or can be formed as separate, shortened sections spaced along the length of the reinforcing body 20. The embodiment shown in FIG. 6 is particularly desirable when the edge protector 16 is used to protect the edges of an article when the article is positioned within a box. The cushion insert 64 provides the required spacing between the inner walls of the packaging box and the product while providing both strength for the edge protector 16 and cushioning for the product being protected.

Various alternatives and embodiments are contemplated as being within the scope of the following claims particularly pointing out and distinctly claiming the subject matter regarded as the invention.

What is claimed is:

1. An edge protector for protecting an edge or corner of an article comprising:

a foam cushion insert having an inner surface adapted to engage the corner of the article, and an outer surface provided with a pair of spaced apart, notched channels; and a reinforcing body formed of a plurality of layers of paperboard plies laminated together, the body having an inner surface engaged against the outer surface of the cushion insert, and a pair of outer edges retained in the channels of the cushion insert.

2. The edge protector of claim 1, wherein the cushion insert and the reinforcing body include a generally right angle cross-section defined by respective first legs and respective second legs of the cushion insert and the reinforcing body.

3. The edge protector of claim 1, wherein the inner surface of the cushion insert defines a corner receiving structure.

4. The edge protector of claim 1, wherein the outer edges of the reinforcing body are inserted in the channels.

5. The edge protector of claim 1, wherein the cushion insert has a length which is substantially equal to a length of the reinforcing body.

6. The edge protector of claim 1, wherein the cushion insert has a thickness that is greater than a thickness of the reinforcing body.

7. The edge protector of claim 1, wherein the cushion insert has a width that is greater than a width of the reinforcing body.

8. The edge protector of claim 1, wherein the reinforcing body lies coextensively along the outer surface of the cushion insert between the spaced channels.

9. The edge protector of claim 1, wherein the cushion insert has a length substantially less than the length of the reinforcing body such that multiple cushion inserts are spaced along the length of the receiving body.

* * * * *